United States Patent [19]

Looger et al.

[11] 4,164,888

[45] Aug. 21, 1979

[54] ROCKET REMOTE ENGAGEMENT MECHANISM

[75] Inventors: Lonnie L. Looger, Madison; Bernie J. Cobb, Huntsville, both of Ala.

[73] Assignee: The United States of America as represented by the Secretary of the Army, Washington, D.C.

[21] Appl. No.: 829,852

[22] Filed: Sep. 1, 1977

[51] Int. Cl.[2] ..... F41F 3/04

[52] U.S. Cl. ..... 89/1.814; 102/8

[58] Field of Search ..... 89/1.814, 1.815, 1.8; 102/8, 19.2, 207, 274; 361/252

[56] References Cited

U.S. PATENT DOCUMENTS

| | | | |
|---|---|---|---|
| 972,141 | 10/1910 | Porter et al. | 361/252 X |
| 1,217,902 | 3/1917 | Beeneck | 361/252 |
| 2,488,228 | 11/1949 | Nims et al. | 361/252 X |
| 2,961,962 | 11/1960 | Jackson | 102/8 X |
| 3,272,125 | 9/1966 | Adams | 102/8 X |
| 3,329,092 | 7/1967 | Bassie | 102/28 X |
| 3,736,836 | 6/1973 | McAllister | 89/1.814 |
| 3,786,717 | 1/1974 | Vickers et al. | 89/1.814 |
| 4,020,764 | 5/1977 | Beermann | 102/8 X |

*Primary Examiner*—David H. Brown

*Attorney, Agent, or Firm*—Nathan Edelberg; Robert P. Gibson; Harold W. Hilton

[57] ABSTRACT

A rocket engagement mechanism that will enable a gunner to pre-aim and then remotely fire the rocket while the gunner is hidden. The gunner is physically separated from the noise and smoke resulting from firing a rocket thus giving the gunner a better chance to escape the resulting return fire. The mechanism can also be used as a booby trap device that can be left by retreating troops to harass and slow the enemy advance. A cap is attached over the firing mechanism of the rocket launcher and has a piston squib positioned to press the launcher firing mechanism when the squib receives an electrical signal.

3 Claims, 3 Drawing Figures

ROCKET REMOTE ENGAGEMENT MECHANISM

DEDICATORY CLAUSE

The invention described herein may be manufactured, used, and licensed by or for the Government for governmental purposes without the payment to us of any royalties thereon.

BACKGROUND OF THE INVENTION

This invention relates to the field of rocket launchers. Present man-portable anti-tank rocket launchers are not provided with a remote engagement device. The current threat includes vast numbers of armored vehicles which would attempt to saturate our defenses. To defend against this threat a large volume, low cost weapon system is needed.

SUMMARY OF THE INVENTION

The present invention has provided a solution to the problem by enabling the gunner to pre-aim and then remotely fire the rocket while the gunner is hidden. This action is made possible by attaching a cap over the launcher firing mechanism and causing a piston squib to actuate the firing mechanism when the squib receives an electrical signal. An alternative of remote firing by the gunner is a target actuated electric impulse generator that is utilized to actuate the squib.

The invention may be better understood from the following detailed description taken in conjunction with the accompanying drawing.

DESCRIPTION OF THE PREFERRED EMBODIMENT

Figure 1:
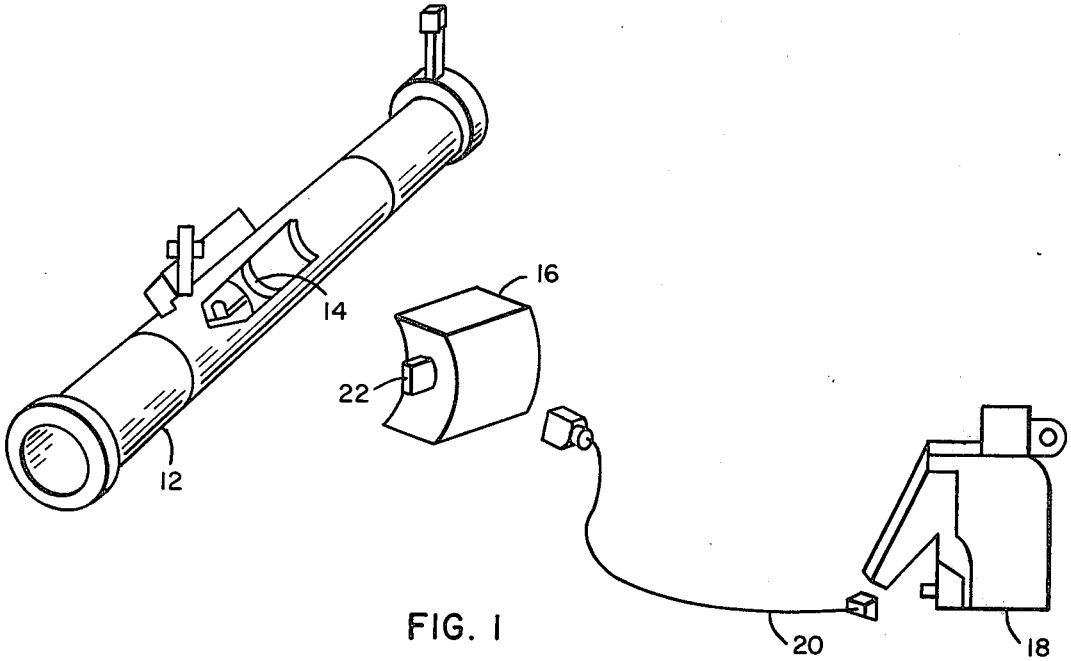
FIG. 1 is a perspective showing the entire rocket system.
Figure 2:
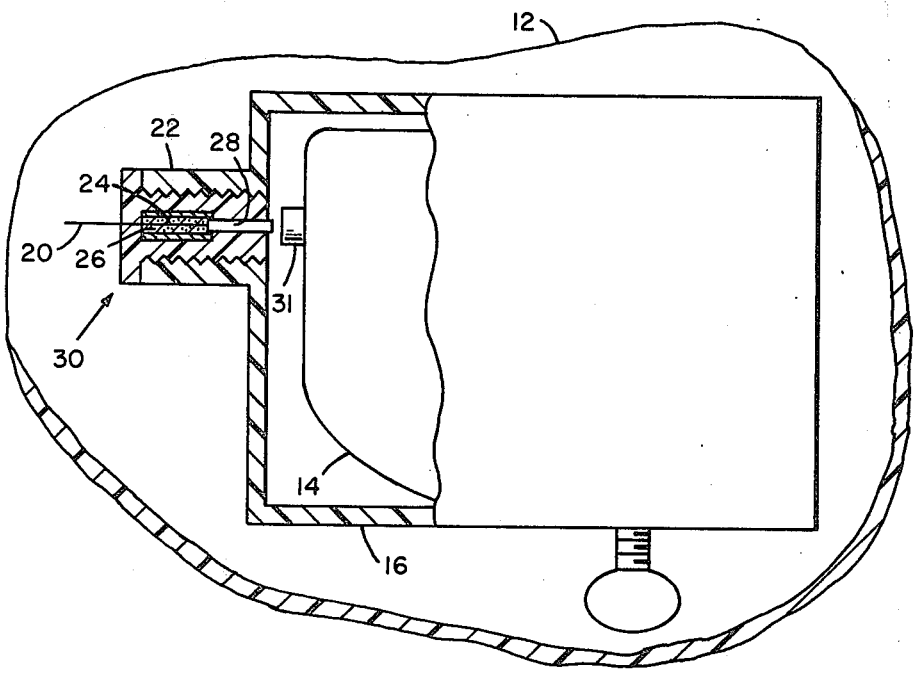
FIG. 2 is a side view of the cap and firing device.

Referring now to the drawing, reference numeral 12 represents a rocket launcher having a rocket firing element 14 attached thereon. A firing device 16, more clearly shown in FIG. 2, is snap mounted on the launcher to actuate firing element 14. A hand operated electrical pulse generator 18 which when closed generates an electrical pulse signal that is transmitted through wires 20 to the firing device 16. As more clearly seen in FIG. 2 the firing impulse is applied to a squib 30 mounted on the device 16 at 22. The squib includes a bridgewire 24 connected to wires 20, gun powder 26 and a movable piston 28 for depressing button 31.

In operation when the generator 18 is operated the electric signal causes the gun powder to ignite which then moves piston 28 to depress button 31 which causes rocket launch.

Figure 3:
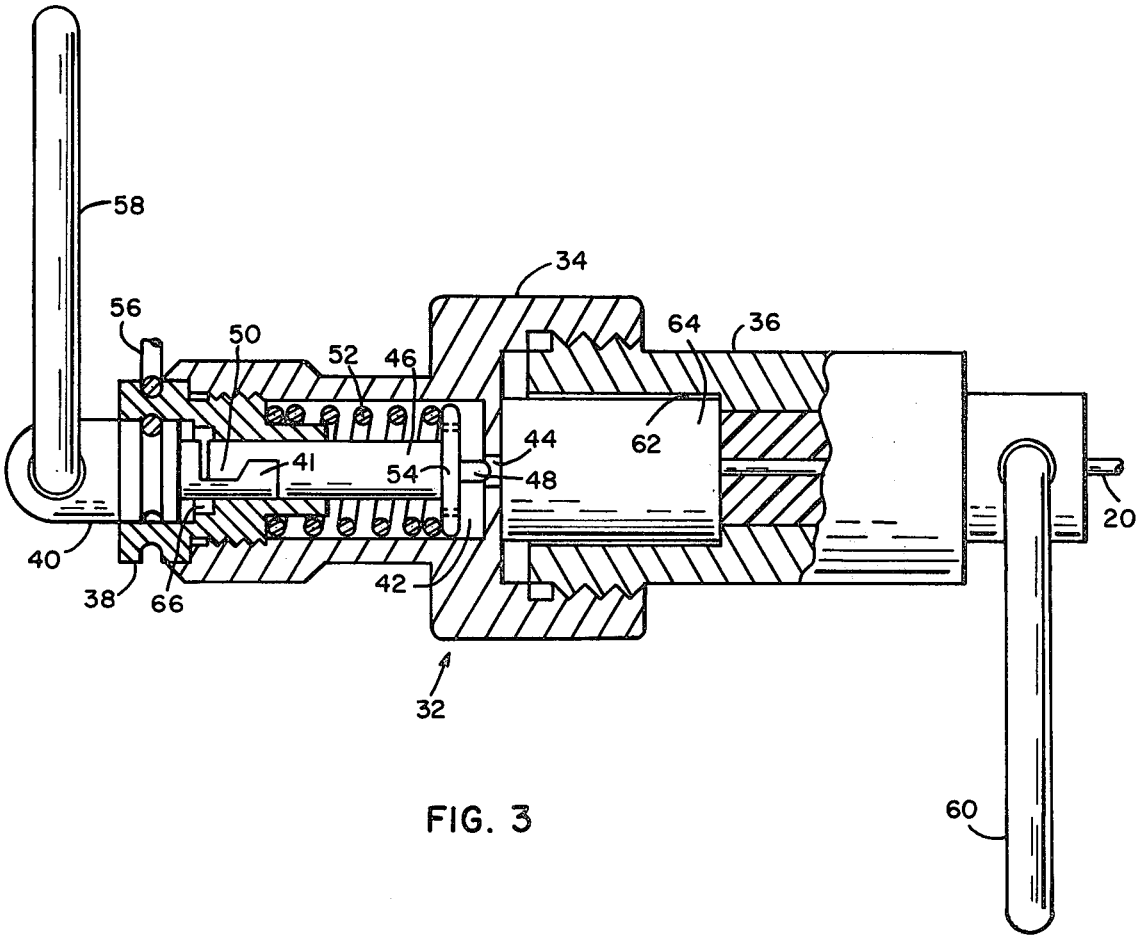
FIG. 3 is a partial sectional view of the target actuator.

When the rocket launcher is to be used as a booby trap to slow enemy advance target operated initiator 32 is used in conjunction with the aforementioned operating elements. The wire 20 is disconnected from electrical pulse generator 18 and connected to one end of the initiator 32. As seen in FIG. 3 the initiator includes a breech 34 having a barrel 36 attached thereto at one end. A sleeve 38 is attached to the opposite end of the breech and is provided with a recess which houses a pull pin 40 having a lower beveled lock element 41. The interior of breech 34 includes a chamber 42 provided with an opening 44. A movable striker point 48 at one end and an upper beveled lock element 50 at the other end engaging lock element 41 at the beveled surfaces. A spring 52 encompasses the striker and has one end abutting sleeve and the opposite end abutting a protrusion 54. Release pin 56 is placed between sleeve 38 and pull pin 40 to prevent movement therebetweeen until the pin is removed. Rings 58 and 60 are attached to the pull pin 40 and barrel 36 respectively and are used for placing the initiator in position. A chamber 62 in barrel 36 houses a shell 64 which is a thermal battery, sending an electric signal to the firing device 16.

When the initiator 32 is placed in operation to utilize the device as a booby trap rings 58 and 60 are secured to wires or rope and placed in the path of an oncoming enemy vehicle. With the release pin 56 disengaged any strain or pull in opposite directions on rings 58 and 60 causes the pull pin 40 and striker to move to the left as viewed in FIG. 3 until element 41 reaches a dropoff section 66 at which point 41 drops therein allowing the cammed mating surfaces of 41 and 50 to slide over each other and disengage. At this point spring 52 which has been compressed or loaded, due to the cocking of striker 46, snaps the now free striker to the right to strike the shell 64 and launch the rocket.

We claim:

1. A rocket engagement mechanism for pre-aiming and remotely firing a rocket comprising: a rocket launcher provided with a firing element; a firing device disposed for actuating said firing element; said firing device including a squib provided with explosive means and a movable piston and a button for effecting launch of said rocket, said button being depressed when said piston is moved by activation of said explosive means; means located remotely from said rocket for generating an electrical signal and means for transmitting said signal to said firing device.

2. A rocket engagement mechanism as set forth in claim 1 wherein said means for producing an electrical signal is a hand operated generator.

3. A rocket engagement mechanism as set forth in claim 1 wherein said means for producing an electric signal is a target operated initiator having a pull pin provided with a lower leveled lock element; a striker provided with an upper leveled lock element at one end engaging said lower lock element and a striker point at the other end, spring means encompassing said striker and biasing said level lock elements into engagement.

* * * * *